United States Patent [19]

Reid

[11] Patent Number: 4,867,754

[45] Date of Patent: Sep. 19, 1989

[54] PROCESS AND COMPOSITION FOR STABILIZED DISTILLATE FUEL OILS

[75] Inventor: Dwight R. Reid, Houston, Tex.

[73] Assignee: Betz Laboratories, Inc., Trevose, Pa.

[21] Appl. No.: 198,016

[22] Filed: May 24, 1988

[51] Int. Cl.[4] ..... C10L 1/22; C10L 1/26

[52] U.S. Cl. ..... 44/72; 44/56; 44/57; 44/66; 44/76

[58] Field of Search ..... 44/72, 76, 56, 57, 66

[56] References Cited

U.S. PATENT DOCUMENTS

| | | | |
|---|---|---|---|
| 2,256,187 | 9/1941 | Bartram | 44/76 |
| 2,261,227 | 11/1941 | Cloud | 44/9 |
| 2,839,563 | 6/1958 | Hechenbleikner | 44/76 |
| 3,017,357 | 1/1962 | Cyba | 252/32.5 |
| 3,309,431 | 3/1967 | Mark et al. | 44/76 |
| 3,490,882 | 1/1970 | Dunworth | 44/73 |
| 3,523,099 | 8/1970 | Shephard et al. | 44/76 |
| 3,558,470 | 1/1971 | Gillespie et al. | 44/76 |
| 3,645,886 | 2/1972 | Gillespie et al. | 44/76 |
| 3,707,362 | 12/1972 | Zimmerman et al. | 44/72 |
| 3,909,214 | 9/1975 | Polss | 44/58 |
| 3,930,810 | 1/1976 | Gattuso | 44/62 |
| 4,002,487 | 1/1977 | Brocckx et al. | 44/66 |
| 4,024,048 | 5/1977 | Shell | 208/48 AA |
| 4,024,050 | 5/1977 | Shell | 208/48 AA |
| 4,024,051 | 5/1977 | Shell | 208/348 |
| 4,509,952 | 9/1985 | Braxton, Jr. | 44/72 |
| 4,542,253 | 9/1985 | Kaplan et al. | 585/560 |
| 4,588,415 | 5/1986 | Zaweski et al. | 44/76 |

*Primary Examiner*—William R. Dixon, Jr.

*Assistant Examiner*—Margaret B. Medley

*Attorney, Agent, or Firm*—Alexander D. Ricci; Steven D. Boyd

[57] ABSTRACT

This invention relates to processes and compositions for stabilizing distillate fuel oil which comprises adding to the distillate fuel oil an effective stabilizing amount of a mixture of (a) a phosphite compound having the formula

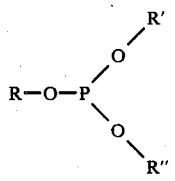

wherein R, R' and R'' are the same or different and are alkyl, aryl, alkaryl or aralkyl groups and these groups may contain oxygen and/or nitrogen, or R and R' may be hydrogen and (b) an effective stabilizing amount of: an organic compound containing a tertiary amine having the formula $T_3N$, wherein the three T groups are the same or different and are alkyl, cycloalkyl, arly, alkyaryl, or aralkyl such that these groups may contain oxygens or additional nitrogens and each T group has from 1 to about 20 carbon atoms; or the reaction product of tallow amine and epichlorohydrin. The weight ratio of (a):(b) is from about 1:50 to about 100:1.

17 Claims, No Drawings

PROCESS AND COMPOSITION FOR STABILIZED DISTILLATE FUEL OILS

BACKGROUND OF THE INVENTION

1. Field of the Invention

This invention relates to stabilized distillate fuel oils. More particularly, this invention relates to inhibiting color deterioration and particulate formation in distillate fuel oils, such as diesel fuel.

2. Description of the Prior Art

Various middle distillate fuel oils, such as diesel fuel and kerosene, tend to deteriorate with time. This deterioration usually results in the formation of sediment, sludge, or gum and objectionable color deterioration. Sediment formation may cause clogging of fuel system equipment such as filters, screens, nozzles, burners and other associated equipment. Discoloration of distillate fuel oils is objectionable for various reasons, including customer's preference for light colored fuel oils because discoloration may indicate that deterioration has occurred.

Suggestions of the prior art for stabilizing fuel oils include U.S. Pat. No. 2,672,408, Bonner, which discloses the use of oil-soluble water-insoluble amines, the general formula of which can be represented as: $N(R)_3$, wherein R can be hydrogen or the same or different hydrocarbon radicals with at least one R being a nonaromatic hydrocarbon radical, for protection of particular blends of liquid hydrocarbons against discoloration. U.S. Pat. No. 2,945,749, Andress, discloses the use of a tertiary alkyl, primary, monoamine having from about 4 to 24 carbon atoms and in which the primary nitrogen atom is directly attached to a tertiary carbon atom, for inhibiting fuel oil deterioration during storage. U.S. Pat. No. 3,049,414, Kruyff, discloses a process for stabilizing the color of gasoline comprising the steps of washing the gasoline with a liquid characterized as being free of heavy metals and capable of dissolving pyridine; washing with alkaline aqueous solution, characterized as being free of heavy metals; removing substantially all the free alkali; and then adding an organic nitrogenous base, all of whose carbon-carbon bonds are saturated. U.S. Pat. No. 3,186,810, Dunworth, discloses a distillate hydrocarbon fuel oil containing a certain oil-soluble, basic amino nitrogen-containing addition type copolymer and an N-substituted cyclohexylamine in which the substituents consist of 1 to 2 alkyl groups of 1 to 4 carbon atoms. Also, U.S. Pat. No. 3,336,124, Dunworth, discloses a distillate hydrocarbon fuel oil containing certain oil-soluble polymeric dispersants and an N-substituted cyclohexylamine in which the substituents consist of 1 to 2 alkyl groups of 1 to 4 carbon atoms.

Of primary interest is U.S. Pat. No. 3,490,882, Dunworth, which relates to stabilized petroleum distillate fuel oils containing N,N-dimethylcyclohexylamine and, optionally, an N,N'-di (ortho-hydroxy-arylidene)-1,2-alkylenediamine. U.S. Pat. No. 3,640,692, Rakow, et. al., discloses a stabilized distillate hydrocarbon fuel oil composition comprising a major proportion of a distillate hydrocarbon fuel and a minor proportion of a stabilizer comprising (a) an additive selected from the group consisting of (1) an amide plus a Schiff base; (2) an amide containing a Schiff base group; and (3) an amide containing a Schiff base group in combination with either an amide or Schiff base; and (b) a cyclohexylamine selected from the group consisting of N,N-dimethylcyclohexylamine and dicyclohexylamine. Also, U.S. Pat. No. 3,701,641, Rakow, et. al., discloses a stabilized distillate hydrocarbon fuel oil composition comprising a major proportion of a distillate hydrocarbon fuel and a minor proportion of a stabilizing additive comprising (a) a polyamine having 2 to about 6 amino groups and containing about 24 to 50 carbons; (b) N,N'-disalicylidine-1,2-propylenediamine, and (c) a cyclohexylamine selected from the group consisting of N,N-dimethyl-cyclohexylamine and dicyclohexylamine.

U.S. Pat. No. 3,355,490, Van Munster, teaches a process for the manufacture of N-alkyl-(or N,N-dialkyl)-cyclohexylamines such as N-methylcyclohexylamine and N,N-dimethylcyclohexylamine and mentions their use as fuel oil additives with no specifics as to the function of the additive in the fuel oil given.

U.S. Pat. No. 4,040,799, Oude Alink et al., discloses the use of N-methylcyclohexylamine, N,N-dimethylcyclohexylamine, and alkyl substituted derivatives of these amines as fuel additives for stabilizing distillate fuels.

U.S. Pat. No. 4,163,646, Oude Alink et al., discloses N,N'-substituted diamines such as N,N'-substituted 2,4-diamino-2-substituted pentanes, wherein the nitrogen function is disubstituted, as fuel stabilizers.

Suggestions of the prior art for stabilizing fuel oils also include U.S. Pat. No. 2,256,187, Bartram, which discloses the use of a condensation product of a phosphorous halide and an organic hydroxyl containing compound, with the preferred class of materials comprising esters of phosphorus acids, to increase the stability of a relatively unstable oil product. Also, U.S. Pat. No. 2,261,227, Cloud, discloses the use of certain organic phosphites as stabilizing ignition promoters of diesel fuel.

The combination of amines and phosphates as additives for various distillate fuels is common in the prior art. U.S. Pat. No. 2,297,114, Thompson, discloses the use of a primary, secondary, or tertiary alkyl amine or an organic ester of phosphoric acid to prevent deterioration of gasoline when exposed to sunlight. U.S. Pat. No. 2,863,904, Cantrell et al., teaches the use of primary N-alkyl amines and di-oxo-octyl acid phosphates in mineral oil compositions to protect metal surfaces from rust or corrosion. U.S. Pat. No. 3,359,083, Von Allmen, discloses a primary amine with hydrocarbyl phosphinic acid to furnish anti-icing and anti-stalling properties to motor fuel compositions. U.S. Pat. No. 3,387,954, Capowski et al., discloses that quaternary amines with the anion being a phosphoric acid radical stabilize liquid hydrocarbon fuels against sediment formation and corrosion. U.S. Pat. No. 3,389,980, Kautsky, discloses the use of primary, secondary, or tertiary alkyl orthophosphoric acid salts of a branched-chain alkyl amine in gasoline to reduce deposits and icing in carburetors.

A monophosphate ester and a diamine, containing both a primary and a secondary amine, were disclosed as a detergent in gasoline in U.S. Pat. No. 3,639,110, Larson. The same combination was disclosed as an anti-icing agent in U.S. Pat. No. 3,771,980, Larson.

Dispersion of particulate matter in distillate products was accomplished with a combination of an amine (primary, secondary, or tertiary) and a phosphate as taught by U.S. Pat. No. 3,751,236, Adams. U.S. Pat. No. 3,895,925, Schlicht et al., teaches the use of an alkyl ammonium alkyl alkanephosphonate as an anti-icing agent and as a corrosion inhibitor for motor fuels. U.S. Pat. No. 3,909,214, Polss, teaches a combination of monoamine salts of branched chain primary alkyl acid esters of orthophosphoric acid and liquid polypropylene controls deposits in engines. U.S. Pat. No. 4,002,437, Broeckx et al., teaches the use of a mixture of a polymeric acid, an amine salt of an oxyo-alkyl acid ester or ortho-phosphoric acid, an aliphatic ester demulsifier and a saturated hydrocarbon solvent to prevent lacquer deposition in diesel fuel engines.

The mixture of the mono- and di-alkyl phosphates and the reaction product of epichlorohydrin with hydrogenated tallow amine was disclosed to prevent deposit formation during the processing, transportation, storage, and/or use of hydrocarbon oils in U.S. Pat. No. 3,017,357, Cyba which is incorporated by reference herein.

In the processing of crude oils, organic esters of phosphates and phosphites with amines have been disclosed as inhibiting and supressing fouling as taught in U.S. Pat. Nos. 4,024,048, 4,024,050, 4,024,051, Shell et al., and 4,542,253, Kaplan et al.

However, none of these prior art references disclose the unique and effective mixture of a phosphite ester compound and a tertiary amine or the reaction product of tallow amine and epichlorohydrin in accordance with the instant invention for inhibiting the color degradation and particulate formation of distillation fuel oils.

SUMMARY OF THE INVENTION

This invention relates to processes for stabilizing distillate fuel oil which comprises adding to the distillate fuel oil an effective stabilizing amount of a mixture of (a) a phosphite compound having the formula

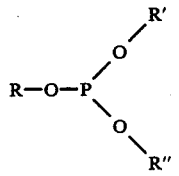

wherein R, R′ and R″ are the same or different and are alkyl, aryl, alkaryl or aralkyl groups having from 1 to about 20 carbon atoms and these groups may contain oxygen and/or nitrogen, or R and R′ may also be hydrogen and (b) an effective stabilizing amount of an organic compound containing a tertiary amine having the formula $T_3N$, wherein the three T groups are the same or different and are alkyl, cycloalkyl, aryl, alkyaryl, or aralkyl such that these groups may contain oxygens or additional nitrogens and each T group has from 1 to about 20 carbon atoms or an effective stabilizing amount of the reaction product of tallow amine or epichlorohydrin.

The weight ratio of (a):(b) is from about 1:50 to about 100:1. This invention also relates to stabilized distillate fuel oil compositions comprising distillate fuel oil and an effective stabilizing amount of (a) and (b) as defined above, wherein the ratio of (a):(b) is from about 1:50 to about 100:1. More particularly, the processes and compositions of this invention relate to inhibiting particulate formation and color deterioration of distillate fuel oils. Generally, the total amount of the mixture of (a) and (b) is from about 1.0 parts to about 10,000 parts per million parts of the fuel oil. It is preferred that the weight ratio of (a):(b) is from about 1:30 to about 20:1. This mixture of (a) and (b) provides an unexpectedly higher degree of stabilization of distillate fuel oils than the individual ingredients comprising the mixture. It is therefore possible to produce a more effective stabilizing composition and process than is obtainable by the use of each ingredient alone. Because of the enhanced stabilizing activity of the mixture, the concentrations of each of the ingredients may be lowered and the total amount of (a) and (b) required for an effective stabilizing treatment may be reduced.

Accordingly, it is an object of the present invention to provide processes and compositions for stabilizing distillate fuel oils. It is another object of this invention to inhibit particulate formation in distillate fuel oils. It is a further object of this invention to inhibit color deterioration of distillate fuel oils. These and other objects and advantages of the present invention will be apparent to those skilled in the art upon reference to the following description of the preferred embodiments.

DESCRIPTION OF THE PREFERRED EMBODIMENTS

The present invention pertains to a process for stabilizing distillate fuel oils having hydrocarbon components distilling from about 300° F. to about 800° F., which comprises adding to the distillate fuel oil an effective stabilizing amount of a mixture of (a) a phosphite compound having the formula

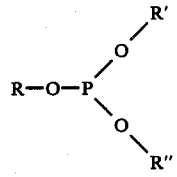

wherein R, R′ and R″ are the same or different and are alkyl, aryl, alkaryl or aralkyl groups having from 1 to about 20 carbon atoms and these groups may contain oxygen and/or nitrogen, or R and R′ may also be hydrogen and (b) an effective stabilizing amount of: an organic compound containing a tertiary amine having the formula $T_3N$, wherein the three T groups are the same or different and are alkyl, cycloalkyl, aryl, alkyaryl, or aralkyl such that these groups may contain oxygens or additional nitrogens and each T group has from 1 to about 20 carbon atoms; or an effective stabilizing amount of the reaction product of tallow amine and epichlorohydrin.

The weight ratio of (a):(b) is from about 1:50 to about 100:1. The amounts or concentrations of the two components of this invention can vary depending on, among other things, the tendency of the distillate fuel oil to undergo deterioration or, more specifically, to form particulate matter and/or discolor. While, from the disclosure of this invention, it would be within the capability of those skilled in the art to find by simple experimentation the optimum amounts or concentration of (a) and (b) for any particular distillate fuel oil, generally the total amount of the mixture of (a) and (b) which is added to the distillate fuel oil is from about 1.0 part to about 10,000 parts per million parts of the distillate fuel oil. Preferably, the mixture of (a) and (b) is added in an amount from about 1.0 part to about 1,500 parts per million. It is also preferred that the weight ratio of (a):(b) is from about 1:30 to about 20:1, based on the total combined weight of these two components. Most preferably, the weight ratio of (a):(b) is about 1:19 based on the total combined weight of these two components.

The two components, (a) and (b), can be added to the distillate fuel oil by any conventional method. The two components can be added to the distillate fuel oil as a single mixture containing both compounds or the individual components can be added separately or in any other desired combination. The mixture may be added either as a concentrate or as a solution using a suitable carrier solvent which is compatible with the components and distillate fuel oil. The mixture can also be added at ambient temperature and pressure to stabilize the distillate fuel oil during storage. The mixture is preferably added to the distillate fuel oil prior to any appreciable deterioration of the fuel oil as this will either eliminate deterioration or effectively reduce the formation of particulate matter and/or color deterioration. However, the mixture is also effective even after some deterioration has occurred.

The present invention also pertains to a stabilized distillate fuel oil composition comprising a major portion of distillate fuel oil, such as blended diesel fuel, and a minor portion of an effective stabilizing amount of (a) a phosphite compound having the formula

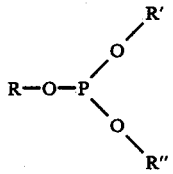

wherein R, R′ and R″ are the same or different and are alkyl, aryl, alkaryl or aralkyl groups having 1 to about 20 carbon atoms and these groups may contain oxygen and/or nitrogen, or R and R′ may also be hydrogen, and (b) an effective stabilizing amount of: an organic compound containing a tertiary amine having the formula $T_3N$, wherein the three T groups are the same or different and are alkyl, cycloalkyl, aryl, alkyaryl, or aralkyl such that these groups may contain oxygens or additional nitrogens and each T group has from 1 to about 20 carbon atoms; or an effective stabilizing amount of the reaction product of tallow amine and epichlorohydrin.

The weight ratio of (a):(b) is from about 1:50 to about 100:1. Generally, the total amount of (a) and (b) is from about 1.0 part to about 10,000 parts per million parts of the distillate fuel oil and, preferably, the total amount of (a) and (b) is from about 1.0 part to about 1,500 parts per million parts of the distillate fuel oil. It is also preferred that the weight ratio of (a):(b) is from about 1:30 to about 20:1 based on the total combined weight of these two components and, most preferably, the weight ratio of (a):(b) is about 1:19 based on the total combined weight of these two components.

The alkyl, aryl, alkaryl or aralkyl groups of the phosphite compound of this invention may be straight or branch-chain groups. Preferably, the alkyl, aryl, alkaryl and aralkyl groups have 1 to about 20 carbon atoms and, most preferably, these groups have from 2 to about 10 carbon atoms. Examples of suitable phosphite compounds include: triethylphosphite, triisopropylphosphite, triphenylphosphite, ethylhexyldiphenylphosphite, triisooctylphosphite, heptakis (dipropylene glycol) triphosphite, triisodecylphosphite, tristearylphosphite, trisnonylphenylphosphite, trilaurylphosphite, distearylpentaerythritoldiphosphite, dinonylisodecylphosphite, diphenylisooctylphosphite, diisooctylphenylphosphite, diethylphosphite, ethylphosphite, and diisodecylpentaerythritolphosphite. Preferably, the phosphite compound is selected from the group consisting of triethylphosphite, triphenylphosphite, ethylhexyldiphenylphosphite, triisooctylphosphite, and heptakis (di-propylene glycol) triphosphite.

The alkyl, cycloalkyl, aryl, alkaryl, or aralkyl groups of the tertiary amine component of this invention may be straight or branch-chain groups. Preferably, the alkyl, cycloalkyl, aryl, alkaryl, or aralkyl groups have from 1 to about 20 carbon atoms and, most preferably, these groups have from 1 to about 10 carbon atoms. Examples of suitable tertiary amine compounds include: N,N,N-triethylamine, N,N,N-tri-n-propylamine, N,N,N-tri-iso-propylamine, N,N,N-tri-n-butylamine, N,N,N-tri-isobutylamine, N,N,N-trisec-butylamine, N,N,N-tri-tert-butylamine, N,N,N-tripentyl-amine, N,N,N,-trihexylamine, N,N,N-triheptylamine, N,N,N-trioctylamine, N,N,N-tridecylamine, N,N,N-tristearylamine, N,N,N-triphenylamine, N,N,N-tribenzylamine, N,N,N-tritoluylamine, N-ethyl-N,N-di-n-propylamine, N-ethyl-N-propyl-N-butylamine, N,N,N-tris-(3,6-dioxaheptyl)-amine, N,N-dimethyl-N-cyclohexylamine, N,N-diethyl-N-cyclohexylamine, and 2-(aminoethyl) piperazine. Preferably, the tertiary amine is selected from the group consisting of N,N-dimethyl-N-cyclohexylamine, N,N-diethyl-N-cyclohexylamine, N,N,N-tris(3,6-dioxaheptyl)amine, and N,N,N-triethylamine. Most preferably, the tertiary amine is N,N-dimethyl-N-cyclohexylamine.

The distillate fuel oils of this invention are those fuel oils having hydrocarbon components distilling from about 300° F. to about 800° F., such as kerosene, jet fuel and diesel fuel. Included are straight-run fuel oils, thermally cracked, catalytically cracked, thermally reformed, and catalytically reformed oil stocks, and blends thereof which are susceptible to deterioration. Preferably, the distillate fuel oil is a blend or mixture of diesel fuels which consists of three components: (1) light cycle oil (LCO), (2) straight-run diesel (STRD), and (3) kerosene. Generally, STRD and kerosene have fewer stability problems. LCO's although less stable, are still acceptable as fuels. However, when the three constituents are blended together, the final diesel fuel product can become unstable. Additionally, some thermally cracked fuel blends can be quite unstable if the process crude stream contains high levels of naturally occurring nitrogen and sulfur compounds.

The processes and compositions of the instant invention effectively stabilize the distillate fuel oils, particularly during storage. The term "stabilized" as used herein means that particulate formation in the distillate fuel oil and color deterioration of the distillate fuel oil are inhibited. The term "particulate formation" is meant to include the formation of insoluble solids, sediment and gum.

In order to more clearly illustrate this invention, the data set forth below was developed. The following examples are included as being illustrations of the invention and should not be construed as limiting the scope thereof.

EXAMPLES

There are several accelerated test methods that are used by refineries for determining the stability of diesel fuels. Some of the most widely accepted test methods are the 110° F. dark storage test (one week to three months), DuPont F21-61, UOP test method 413, 80° C.

test, and the 216° F. test. It was observed that some diesel fuels respond positively to selected chemical additives under specific conditions. In some cases, additives that were effective under accelerated test conditions (e.g., 216° F., 300° F.), were occasionally found to perform poorly under the more moderate 110° F. test. This observation agrees with those found in recent literature. See Stavinoha, L. L., et al., *Accelerated Stability Test Techniques for Diesel Fuels,* October, 1980. Stability data obtained using the 216° F. or 300° F. accelerated tests are considered to be only qualitative indicators of the performance expectations of an additive under the highly regarded 110° F. storage test condition. It is widely accepted among researchers that seven days at 110° F. is equivalent to one month's storage at 72° F. Although the results of the 110° F. dark storage test are generally accepted as the only valid data in correlating data from these conditions to those from actual storage, some current manufacturers continue to rely on stability data from the more accelerated conditions.

Tests were conducted to determine the effect of the components to inhibit both color deterioration and solids formation of a diesel fuel using the 90 minute, 300° F. accelerated test method. 50 mL of the diesel fuel sample spiked with the appropriate treatment was filtered through a Whatman No. 1 filter paper and into a test tube. The test tube was then supported in an oil bath maintained at 300°±2° F. The bath oil level was kept above the sample level in the test tube. After 90 minutes, the test tube was removed from the oil bath and stored at room temperature for another 90 minutes. The sample was then filtered through a clean Whatman No. 1 filter paper with moderate vacuum. The color of the sample was determined by visual comparison with known standards according to the ASTM-D-1500 procedure, which involved matching the color of the fuel samples with ASTM-1500 color numbers. The results are based on a scale of 0.5 to 8.0 wherein increasing values indicate increasing darkness of the sample. The results obtained are reported in Table I below.

TABLE I

The Effect of Phosphites and Amines on Inhibiting Color Degradation on Fuels Containing 25% Light Cycle Oil, the Balance Composed of Straight Run and Kerosene from a Southern Refinery. A 90-Minute Heating Period at 300° F. Was Used to Accelerate the Degradation.

| Sample Description | Concentration Level (ppm) | Color Level ASTM D-1500 |
|---|---|---|
| Untreated | — | 2.8 |
| Triethylphosphite | 3.3 | 2.7 |
| Triisopropylphosphite | 3.3 | 2.7 |
| N,N—dimethylcyclohexylamine[a] | 100 | 2.4 |
| Tris(3,6-dioxaheptyl)amine[a] | 100 | 2.5 |
| Di-isobutylamine[b] | 100 | 2.8 |
| Dicyclohexylamine[b] | 100 | 2.5 |
| N,N—dimethylcyclohexamine/triisopropylphosphite | 100/3.3 | 2.0 |
| Tris(3,6-dioxaheptyl)amine/triisopropylphosphite | 100/3.3 | 2.2 |
| Di-isobutylamine/triethylphosphite | 100/3.3 | 2.8 |
| Dicyclohexylamine/triethylphosphite | 100/3.3 | 2.5 |

[a]tertiary amine
[b]secondary amine

The results reported in Table I demonstrate the unique and exceptionally effective relationship of the components of this invention since the samples containing both the phosphite compound and tertiary amine show better overall effectiveness in stabilizing the color degradation of the diesel fuel than was obtainable in using each of the components individually. The combinations of secondary amines and phosphites did not show any improvement in color stabilization over the individual components.

Further tests were conducted to determine the effect of the components of this invention to inhibit color formation of a diesel fuel sample from a Southern refinery containing 18% light cycle oil with the balance being straight-run diesel and kerosene using the 90-minute heating period at 300° F. to accelerate degradation. The results obtained are reported in Table II below.

TABLE II

The Effect of Phosphites and Amines on Inhibiting Color Degradation on Fuels Containing 18% Light Cycle Oil, the Balance Composed of Straight Run and Kerosene from a Southern Refinery. A 90-Minute Heating Period at 300° F. Was Used to Accelerate the Degradation.

| Sample Description | Concentration Level (ppm) | Color Level ASTM D-1500 |
|---|---|---|
| Untreated | — | 2.8 |
| Triethylamine[a]/triethylphosphite | 50/2.7 | 2.5 |
| N,N—dimethylcyclohexamine[a]/triisopropylphosphite | 50/2.7 | 2.3 |
| N—butylamine[b]/triethylphosphite | 50/2.7 | 3.3 |
| Cyclohexylamine[b]/triethylphosphite | 50/2.7 | 3.3 |
| Ethanolamine[b]/triethylphosphite | 50/2.7 | 3.0 |
| Triethylphosphite | 2.7 | 2.8 |

[a]tertiary amine
[b]primary amine

The results reported in Table II demonstrate the superior efficacy of the phosphite/tertiary amine combination of this invention versus phosphite/primary amine combinations.

Additional tests were conducted to study the effect of the phosphite compounds and tertiary amines or the reaction product tallow amine and epichlorohydrin to inhibit sediment formation of a diesel fuel sample from a Southwestern refinery containing 100% FCC light cycle oil using a one-month heating period at 110° F. to accelerate degradation. The results obtained are reported in Table III below.

TABLE III

The Effect of Phosphites and Amines on Inhibiting Color Degradation and Sediment Formation on a Fuel Composed of 100% FCC Light Cycle Oil from a Southwestern Refinery. A One-Month Heating Period at 110° F. Was Used to Accelerate Degradation. Color of the Fuel Was Determined Using ASTM D-1500; Sediment Was Determined by Filtering the Fuel Through a 0.8 um Millipore Filter. (As received color of FCC LCO = 2.8.)

| Sample Description | Concentration Level (ppm) | Quantity of Sediment (mg/100 ml) | Color Level |
|---|---|---|---|
| Untreated | — | 14.0 | >8 |
| Triethylphosphite | 100 | 3.5 | >8 |
| Amine based dispersant[a] | 100 | 3.0 | >8 |
| Triethylphosphite/amine based dispersant[a] | 70/30 | 1.2 | >8 |
| N,N—Diethylcyclohexylamine | 100 | 0.8 | >8 |
| N,N—Dimethylcyclohexylamine/ Triethylphosphite | 38/2 | 1.4 | >8 |

[a]Believed to be the reaction product of tallow amine and epichorohydrin

The results reported in Table III further demonstrate the substantial efficacy of the phosphite/tertiary amine combination of this invention for solid inhibition and also show that the instant invention demonstrates the substantial efficacy of the phosphite/reaction product of tallow amine and epichlorohydrin.

Tests were conducted to further study the effect of phosphites and phosphite/tertiary amine mixture to inhibit both color degradation and sediment formation of a diesel fuel sample from a Southwestern refinery containing 30% FCC light cycle oil with 35% straight-run diesel and 35% kerosene using a one-month heating period at 110° F. to accelerate degradation. The results obtained are reported in Table IV below.

TABLE IV

The Effect of Phosphites and Amines on Inhibiting Color Degradation and Sediment Formation on a Fuel Composed of 30% FCC Light Cycle Oil, 35% Straight Run and 35% Kerosene from a Southwestern Refinery. A One-Month Heating Period at 110° F. Was Used to Accelerate Degradation. (As received color of blend = 1.5)

| Sample Description | Concentration Level (ppm) | Quantity of Sediment (mg/100 ml) | Color Level |
|---|---|---|---|
| Untreated | — | 4.7 | 6.5 |
| Triethylphosphite | 30 | 2.5 | 5.5 |
| | 50 | 2.0 | 4.8 |
| Amine based dispersant[a] | 30 | 2.6 | 5.4 |
| | 50 | 2.9 | 4.7 |
| Triethylphosphite/amine based dispersant[a] | 21/9 | 1.4 | 5.2 |
| | 35/15 | 1.7 | 4.5 |
| N,N—Diethylcyclohexylamine | 30 | 3.0 | 5.4 |
| | 50 | 1.7 | 4.6 |
| N,N—Dimethylcyclohexylamine/ | 11.4/.6 | 2.2 | 5.5 |
| triethylphosphite | 19/1.0 | 1.6 | 5.5 |

[a]Believed to be the reaction product of tallow amine and epichlorohydrin

The results reported in Table IV also indicate that the tertiary amines or the reaction product of tallow amine and epichlorohydrin, when combined with the phosphites, effectively inhibit sediment formation and color degradation.

Tests were also conducted to study the effect of various additives to inhibit color degradation of a diesel fuel sample from another Southwestern refinery containing an FCC light cycle oil using a 90-minute heating period at 300° F. to accelerate degradation. The results obtained are reported in Table V below.

TABLE V

The Effect of Phosphites and Amines on Inhibiting Color Degradation of a FCC Feedstock from a Second Southwestern Refinery. A 90-Minute Heating Period at 300° F. Was Used to Accelerate the Degradation Followed by a 90-Minute Cool-Down Period Prior to Measurements. (As received color = 1)

| Sample Description | Concentration Level (ppm) | Color Level |
|---|---|---|
| Untreated | — | 3.8 |
| Triethylphosphite | 50 | 2.7 |
| Amine based dispersant[a] | 50 | 2.8 |
| Triethylphosphite/amine based dispersant[a] | 50/21 | 2.3 |
| N,N—Diethylcyclohexylamine | 50 | 2.8 |
| N,N—Dimethylcyclohexylamine/ triethylphosphite | 19/1.0 | 2.6 |

[a]Believed to be the reaction product of tallow amine and epichlorohydrin

The results reported in Table V indicate that the phosphite/tertiary amine mixture and the phosphite/amine based dispersant mixture are effective at inhibiting color deterioration.

Tests were conducted to study sediment formation of a diesel fuel from a Southern refinery containing 20% light cycle oil with the balance being straight-run diesel and kerosene using a 90-minute heating period at 300° F. to accelerate degradation. The results obtained are reported in Table VI below.

TABLE VI

| SAMPLE | CONCENTRATION OF ADDITIVE(S) (PPM) | QUANTITY OF DEPOSITS ON FILTER PAPER (mg)/50 mls |
|---|---|---|
| 1. Untreated | — | 23.5 |
| | — | 25.7 |
| | — | 27.6 |
| | — | 29.4 |
| | — | 22.3 |
| | — | 22.4 |
| | — | 20.0 |
| | — | 20.8 |
| | | 24.0 Average |
| 2. N,N—Dimethyl-N—cyclohexyl-amine (DMCA) | 100 | 41.8 |
| | 100 | 9.0 |
| | 100 | 17.2 |
| | 75 | 42.6 |
| | 50 | 19.1 |
| | 37.5 | 19.3 |
| | 18.75 | 14.0 |
| | 9.375 | 18.0 |
| | | 22.6 Average |
| 3. 5% Triisopropylphosphite 95% DMCA | 100 | 8.8 |
| | 100 | 9.7 |
| | | 9.3 Average |
| 4. 5% Triethylphosphite 95% DMCA | 100 | 12.6 |
| | 75 | 10.6 |
| | 50 | 15.8 |
| | 37.5 | 17.4 |
| | 18.75 | 12.0 |
| | 9.375 | 18.0 |
| | | 14.4 Average |

The results reported in Table VI indicate the substantial efficacy of the phosphite/tertiary amine mixtures to inhibit color degradation and sediment formation.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A process for inhibiting deterioration of distillate fuel oil which comprises adding to said fuel oil an effective inhibiting amount of a synergistic mixture of (a) a phosphite compound having the formula

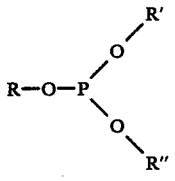

wherein R, R′ and R″ are the same or different alkyl, aryl, alkaryl or aralkyl having from 1 to about 20 carbon atoms and these groups may contain oxygen and/or nitrogen, or R and R′ may be hydrogen, and (b) a tertiary amine having the formula $T_3N$ wherein the T groups are the same or different and are alkyl, cycloalkyl, aryl, alkyaryl or aralkyl groups with from 1 to about 20 carbon atoms, or the reaction product of tallow amine and epichlorohydrin, wherein the weight ratio of (a):(b) is from about 1:50 to about 100:1.

2. The process of claim 1 wherein said mixture is added in an amount from about 1.0 part to about 10,000 parts per million parts of said fuel oil.

3. The process of claim 1 wherein said mixture is added to said fuel oil prior to color deterioration of said fuel oil.

4. The process of claim 1 wherein said (a) phosphite is triisopropylphosphite and said (b) tertiary amine is N,N-dimethyl-N-cyclohexylamine.

5. The process of claim 1 or 4 wherein the weight ratio of (a):(b) is from about 1:30 to about 20:1.

6. The process of claim 5 wherein the distillate fuel oil is a blended diesel fuel.

7. The process of claim 6 wherein the weight ratio of (a):(b) is about 1:19.

8. The process of claim 7 wherein said mixture is added in an amount from about 1.0 part to about 1,500 parts per million parts of said diesel fuel.

9. A stabilized distillate fuel oil composition comprising distillate fuel oil and an effective stabilizing amount of a synergistic mixture of (a) a phosphite having the formula

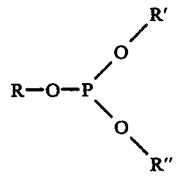

wherein R, R′ and R″ are the same or different alkyl, aryl, alkaryl or aralkyl having from 1 to about 20 carbon atoms and these groups may contain oxygen and/or nitrogen, or R and R′ may be hydrogen and (b) a tertiary amine having the formula $T_3N$ wherein the T groups are the same or different and are alkyl, cycloalkyl, aryl, alkyaryl or aralkyl groups with from 1 to about 20 carbon atoms, or the reaction product of tallow amine an epichlorohydrin, wherein the weight ratio of (a):(b) is from about 1:50 to about 100:1.

10. The composition of claim 9 wherein the total amount of (a) and (b) is from about 1.0 part to about 10,000 parts per million parts of said fuel oil.

11. The composition of claim 9 wherein the weight ratio of (a):(b) is from about 1:30 to about 20:1.

12. The composition of claim 9 or 11 wherein said (a) phosphite is triisopropylphosphite and said (b) tertiary amine is N,N-dimethyl-N-cyclohexylamine.

13. The composition of claim 12 wherein the distillate fuel oil is a blended diesel fuel.

14. The composition of claim 13 wherein the weight ratio of (a):(b) is about 1:19.

15. The composition of claim 14 wherein the total amount of (a) and (b) is from about 1.0 part to about 1,500 part per million parts of said diesel fuel.

16. The process of claim 1 wherein said (a) phosphite is triethylphosphite and said (b) tertiary amine is N,N-dimethyl-N-cyclohexylamine.

17. The composition of claim 9 wherein said (a) phosphite is triethylphosphite and said (b) tertiary amine is N,N-dimethyl-N-cyclohexylamine.

* * * * *